US006875934B2

(12) United States Patent
Liu et al.

(10) Patent No.: US 6,875,934 B2
(45) Date of Patent: Apr. 5, 2005

(54) KEYSTROKE STRUCTURE FOR ELECTRONIC DEVICES

(75) Inventors: Ta-Wei Liu, Taipei (TW); Duan-Ying Lin, Taipei (TW)

(73) Assignee: High Tech Computer Corp., TaoYuan (TW)

( * ) Notice: Subject to any disclaimer, the term of this patent is extended or adjusted under 35 U.S.C. 154(b) by 48 days.

(21) Appl. No.: 10/617,775

(22) Filed: Jul. 14, 2003

(65) Prior Publication Data

US 2004/0080436 A1 Apr. 29, 2004

(30) Foreign Application Priority Data

Oct. 25, 2002 (TW) ..... 91306102

(51) Int. Cl.[7] ..... H01H 25/04
(52) U.S. Cl. ..... 200/6 A; 200/5 R
(58) Field of Search ..... 200/1 R, 1 B, 200/4, 5 R, 6 A, 17 R, 18, 329, 332, 335, 339; 341/22; 345/157, 161, 184

(56) References Cited

U.S. PATENT DOCUMENTS 4,256,931 A * 3/1981 Palisek ..... 200/5 A
5,584,380 A * 12/1996 Naitou ..... 200/315
6,153,840 A * 11/2000 Dreher ..... 200/301
6,590,174 B2 * 7/2003 Zysnarski et al. ..... 200/310
6,635,831 B2 * 10/2003 Kato ..... 200/4
6,667,450 B2 * 12/2003 Bulin et al. ..... 200/302.3
6,771,992 B1 * 8/2004 Tomura et al. ..... 200/4
6,797,896 B2 * 9/2004 Lee ..... 200/6 A

* cited by examiner

*Primary Examiner*—Michael A. Friedhofer
(74) *Attorney, Agent, or Firm*—Troxell Law Office, PLLC

(57) ABSTRACT

A keystroke structure (3) for an electronic device which includes a shell (2) defining an opening (22). The keystroke structure comprises a cap (32) made of hard plastics such as ABS resin, a flange (34) fixed to a bottom of a periphery of the cap, wherein the flange is made of a material, such as rubber which is more elastic than that for forming the cap. The cap has a portion extending upward through the opening. A rod (42) extends downwardly from a bottom of the cap. A switch assembly (4) consisting of four first switches (44) for cursor direction control and a second switch (46) for "enter" control. The first switches are activated by the rod when the cap is titled, and the second switch is activated by the rod when the cap is vertically depressed. When the cap is titled to activate one of the first switches, the flange engage with a bottom face of the shell. Since the flange is made of resilient material, the engagement thereof with the shell will not cause the second switch to be also activated when the cap is titled to activate one of the first switches. Such a design is particularly advantageous when the electronic device has a reduced thickness.

18 Claims, 4 Drawing Sheets

KEYSTROKE STRUCTURE FOR ELECTRONIC DEVICES

FIELD OF THE INVENTION

The invention relates to a keystroke structure for electronic devices, and more particularly, to a keystroke structure that has multiple functions, i.e., a "four-direction" function and an "enter" function. The keystroke structure is particularly suitably used in a handheld electronic device having a reduced thickness.

BACKGROUND OF THE INVENTION

Accordingly, the development of electronic industry is extremely fast; in particularly, the 3C electronic products (i.e., computer, communicating product, and consuming electronic device, etc.) are much more outstanding; the convenience in living brought by them makes the modern people unable to live without using 3C products and, aiming to the different needs required by different consumers, the market mechanism also develops many products with different functions, prices, and volumes, such that the consumers may have more selections; for example, a desktop PC is commonly used in home or working occasion for the usage of data management, drawing, and internet, etc; a notebook PC is often used when the user is out of home and is unable to carry a heavy desktop PC, but the user also has to bear the drawbacks of a notebook PC: its price is higher than that of a desktop PC, the sustaining power of battery is insufficient, and the problem of its uneasy upgrade for operation and apparatus, etc; furthermore, someone still complains that the notebook PC is too heavy to carry, so there is a birth of personal digital assistant (abbreviated as PDA), of which the structure is simplified from that of a computer, and which applies a simpler operation system (such as, those two groups of Palm and Win CE), such that a user may use the simple functions of internet, document management, recording personal data, etc. and, accordingly, its volume and weight are easy to carry (e.g., it can be carried in the pocket of upper clothes), and its price is also cheap, such that it is a favorite for specific hi-tech group, and its popularity in market is so obvious that everybody can be observed; therefore, the invention is a further improvement for the structure of a PDA, such that the invention may achieve the object of a more humanly convenient usage.

Please refer to FIG. 1A and FIG. 1B, which show a keystroke structure 12 that is applicable in a personal digital assistant (PDA) or other handheld electronic devices to control a cursor movement in a displaying screen and an "enter" command thereof. The keystroke structure 12 has a cap 122 with a bottom flange 124. A rod 142 extends downwardly from a bottom of the cap 122. Four switches 144 for direction control of movement of the cursor are arranged around a periphery of the rod 142. By activating the four switches 144 by tilting the cap 122 and accordingly the rod 142 in four directions, the cursor on the screen can move in four directions (i.e., upward, downward, leftward and rightward directions.) A further switch 146 for "enter" control is arranged under the rod 142 and, by vertically depressing the cap 122 and accordingly the rod 142, the switch 146 is activated to obtain an "enter" command whereby a soft key on the screen pointed by the cursor is activated. The keystroke structure 12 is arranged on a circuit board 148 in a shell 10 of the electronic device. A switch assembly 14 accommodating the five switches 144 and 146 is mounted on the circuit board 148. A hole 13 is defined in the shell 10. An upper part of the cap 122 extends upwardly through the hole 13 to facilitate the operation of the keystroke structure 12. The cap 122 and flange 124 of the conventional keystroke structure 12 are integrally formed by plastic injection molding of hard plastic material, such as ABS (Acrylonitrile-Butadiene-Styrene) resin. When the profile (thickness) of the electronic device is lowered so that a stroke of the keystroke structure 12 is reduced, the conventional keystroke structure 12 faces a problem that when the keystroke structure 12 is titled in order to move the cursor in a selected direction, the flange 124 abuts against the shell 10 before the related switch 144 for direction control is activated. Further depressing the cap 122 causes not only the related switch 144 for direction control but also the switch 146 for "enter" control to be activated; thus, the keystroke structure 12 causes the cursor on the screen to have an incorrect action.

SUMMARY OF THE INVENTION

Accordingly, the invention is to provide a keystroke structure for an electronic device, in which the keystroke structure can control a four directional movement of a cursor and an "enter" function of the electrical device. The main object of the invention is to form such a keystroke structure which has a cap made of a hard material and a flange made of a soft (elastic) material. The flange extends around a bottom portion of a periphery of the cap. By such a design, when the keystroke structure is titled to activate a switch for direction control, even if the stroke of the keystroke structure is reduced, the abutment of the flange and a shell of the electronic device will not hinder the proper activation of the related switch for direction control. In other words, the abutment between the flange and the shell will not cause the switch for direction control and the switch for "enter" control to be simultaneously activated when the keystroke structure is titled to activate the switch for direction control. To activate the switch for "enter" control, the keystroke structure needs to be vertically depressed.

Another object of the invention is to provide a keystroke structure which can have a four-way direction control and an "enter" control, and which can function properly when the keystroke structure is used in an electronic device having a low profile (reduced thickness).

To achieve above objects, a keystroke structure for an electronic device according to the invention is comprised of following components: a key cap, which is arranged in an opening of an outer shell of an electronic device, and which has at least one part exposing from the opening to the outside of the outer shell; the cap is made of hard plastic material such as ABS resin. A flange made of resilient rubber is provided around a bottom of a periphery of the cap. A rod extends downward from the bottom of the cap. A switch assembly is mounted on a printed circuit board. The switch assembly has four switches for direction control and a switch for "enter" control. The flange is provided to prevent the keystroke structure from inadvertently separating from the electronic device. When the keystroke structure is depressed slantly to activate a directional movement of a cursor, the engagement of the flange and the shell will not cause the rod of the keystroke structure to activate the switch for "enter" control, since the flange is made of resilient material so that it is deformed when it engages with the shell. The deformation of the flange enables the rod to be properly tilted to activate the corresponding switch for direction control of the movement of the cursor on the displaying screen of the electronic device.

In order to further understand and recognize the objects of the invention, a detailed description incorporated with corresponding drawings is presented as the follows.

DETAILED DESCRIPTION OF THE INVENTION

Figure 1A:
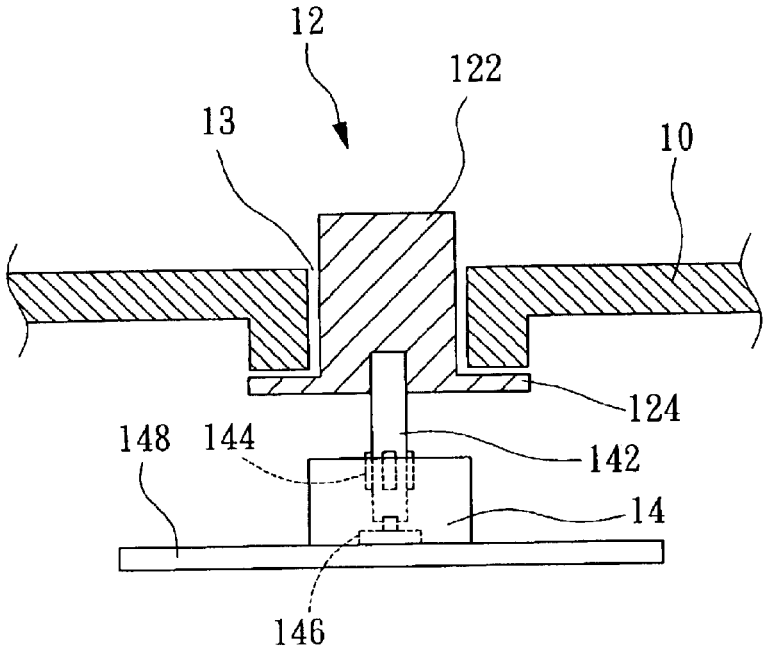
FIG. 1A (PRIOR ART)
FIG. 1A is a cross-sectional view showing relative position between a keystroke structure and an outer shell of an electronic device according to prior art.
Figure 1B:
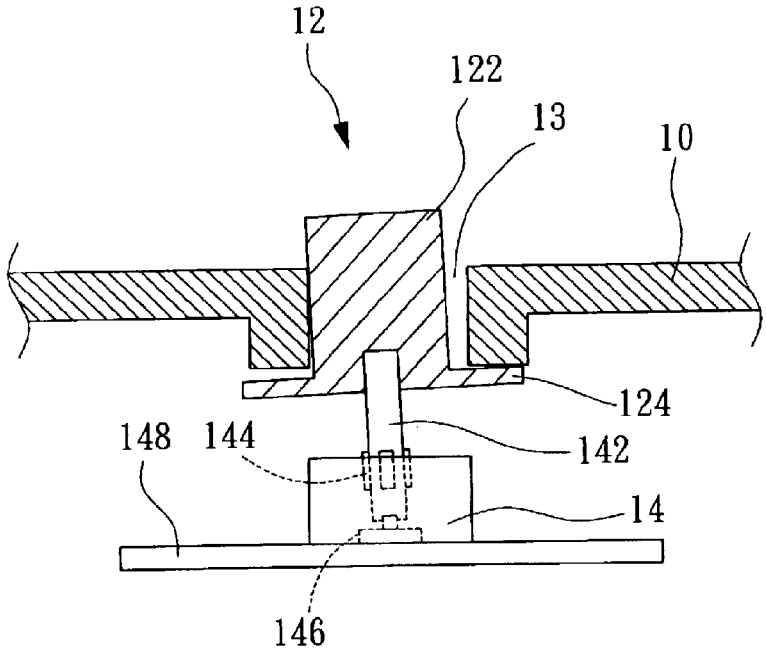
FIG. 1B (PRIOR ART)
FIG. 1B is a view similar to FIG. 1A, illustrating the keystroke structure being depressed to activate a switch for cursor movement control in a predetermined direction.

The other object and detailed contents of the invention will be further accurately understood from the following detailed description; of course, the invention allows some differences in some elements or the arrangement thereof but, in this patent application, the selected embodiments will be described in detail and its structure will be illustrated in the attached drawings as well, such that the technical details of the invention will be further clearly disclosed, and the structures, of the selected embodiments of the invention, shown in the drawings, are only applied for description herein, and are not applied as restrictions for this patent application.

Figure 2:
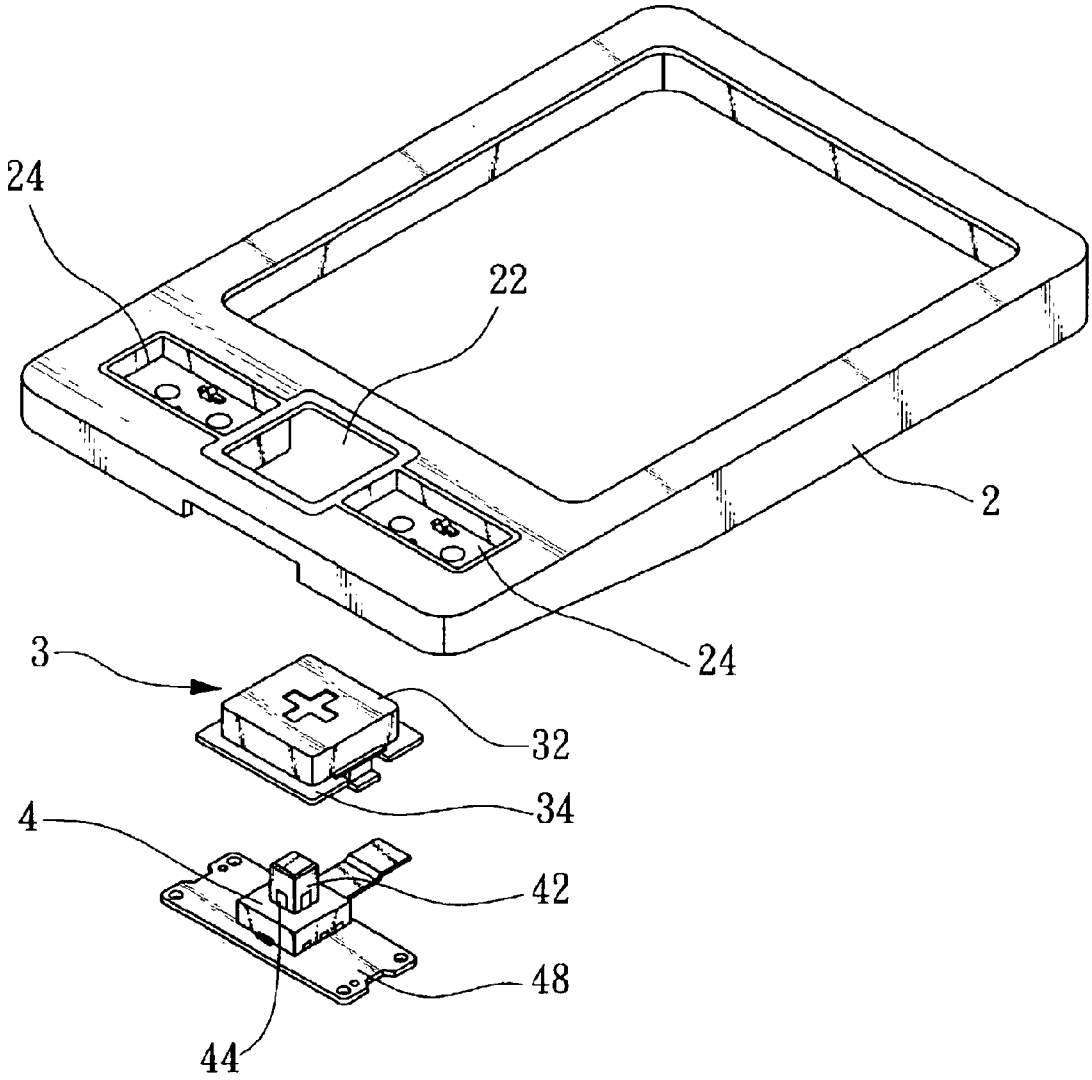
FIG. 2 is a perspective exploded view of a portion of a handheld electronic device in accordance with the present invention, showing an outer shell, a keystroke structure, a switch assembly and a printed circuit board.
Figure 3:
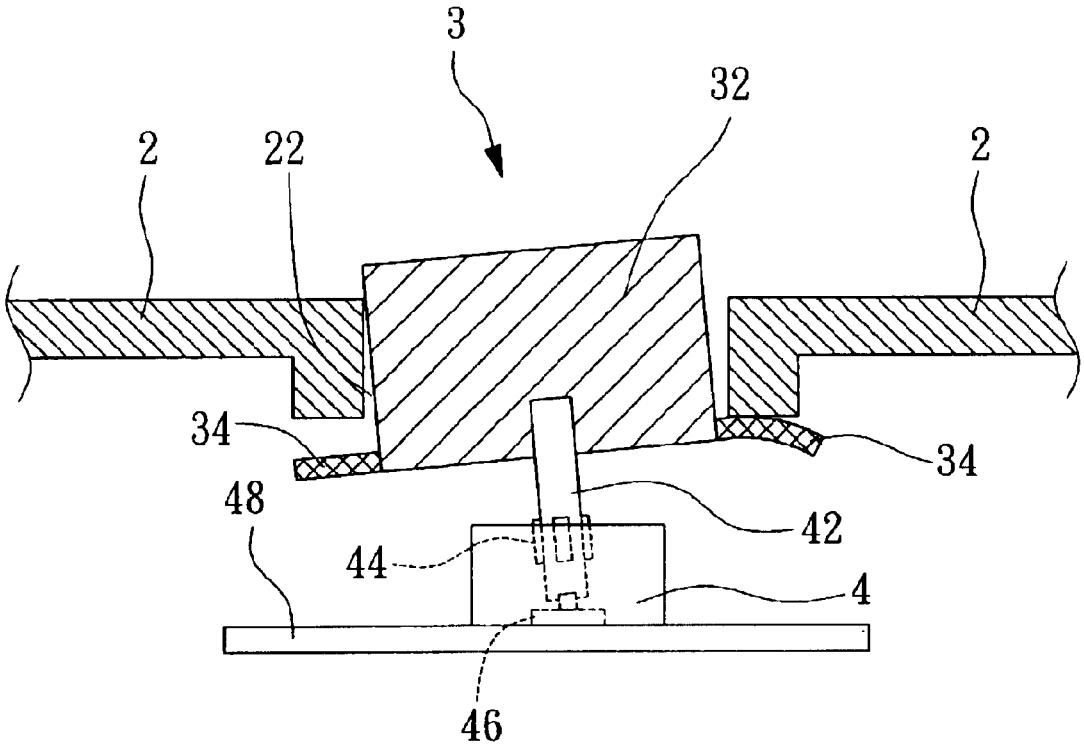
FIG. 3 is a cross-sectional view of FIG. 2, showing the keystroke structure being depressed to activate a switch for cursor movement control in a predetermined direction.

Please refer to FIGS. 2 and 3, wherein FIG. 2 is a perspective exploded view of a portion of a handheld electronic device in accordance with the present invention, which includes an outer shell 2, a keystroke structure 3, a switch assembly 4, and a printed circuit board 48. The switch assembly 4 is soldered to the printed circuit board 148. In the preferred embodiment, the handheld electronic device is a personal digital assistant (PDA). An accommodation hole 22 is arranged in an appropriate position of the outer shell 2 of the electronic device. Two accommodation chambers 24 are further arranged respectively at two sides of the accommodation hole 22 for accommodating operating buttons (not shown) of the handheld electronic device. The switch assembly 4 is used for controlling four directional movements (upward, downward, leftward and rightward movements) of a cursor on a displaying screen (not shown) of the handheld electronic device, and an "enter" action of the handheld electronic device. The keystroke structure 3 consists of a cap 32 made of hard plastics such as ABS (Acrylonitrile-Butadiene-Styrene) resin, a flange 34 made of resilient plastics such as rubber and a rod 42. The flange 34 is fixed to a bottom of a periphery of the cap 32 and extends laterally. The rod 42 has a lower end mounted in the switch assembly 4. In assembly, the printed circuit board 48 together with the switch assembly 4 and the rod 42 is mounted on a frame (not shown) of the handheld electronic device. The cap 32 together with the flange 34 is mounted to the rod 42 with an upper end of the rod 42 fitted in a bottom of the cap 32. Finally, the shell 2 is fastened to the frame at a position in which an upper part of the cap 32 extends upwardly through the accommodation hole 22.

Particularly referring to FIG. 3, in use, when the user presses down a left part of the cap 32 in order to activate the left one of the switches 44 for cursor movement control in predetermined directions, the left side of the flange 34 is slanted downward and, in the mean time, the right side of the flange 34 is moved upward to engage with a bottom of the shell 2. Since the flange 34 is constructed of an elastic material, the engagement of the right side of the flange 34 and the shell 2 does not obstruct the left part of the cap 32 to be properly depressed so that the left one of the switches 44 can be properly activated by the rod 42 to move the cursor in a predetermined direction. In the present invention, the engagement between the flange 34 and the shell 2 does not cause the switch 46 for "enter" control to be activated when the cap 32 is titled to activate one of the switches 44 for cursor movement control in selected directions. Such a feature is particularly important when the keystroke structure 3 is used in a handheld electronic device having a reduced thickness, since in such a device, the keystroke structure 3 has a reduced stroke and the engagement between the flange 34 and the shell 2 always happens when the cap 32 is tilted in order to activate the switches 44 for movement control of the cursor in selected directions. If the flange 34 is made of hard material, like the hard plastics of the prior art, the engagement between the flange 34 and the shell 2 will cause the switch 46 for "enter" control to be also activated when the keystroke structure 3 is operated only to activate the switches 44 for cursor movement control by tilting the cap 3. Nevertheless, this drawback of the prior art is overcome by the present invention. To activate the switch 46 for "enter" control, the user needs to vertically depress the cap 32 of the keystroke structure 3 in accordance with the present invention.

Figure 4:
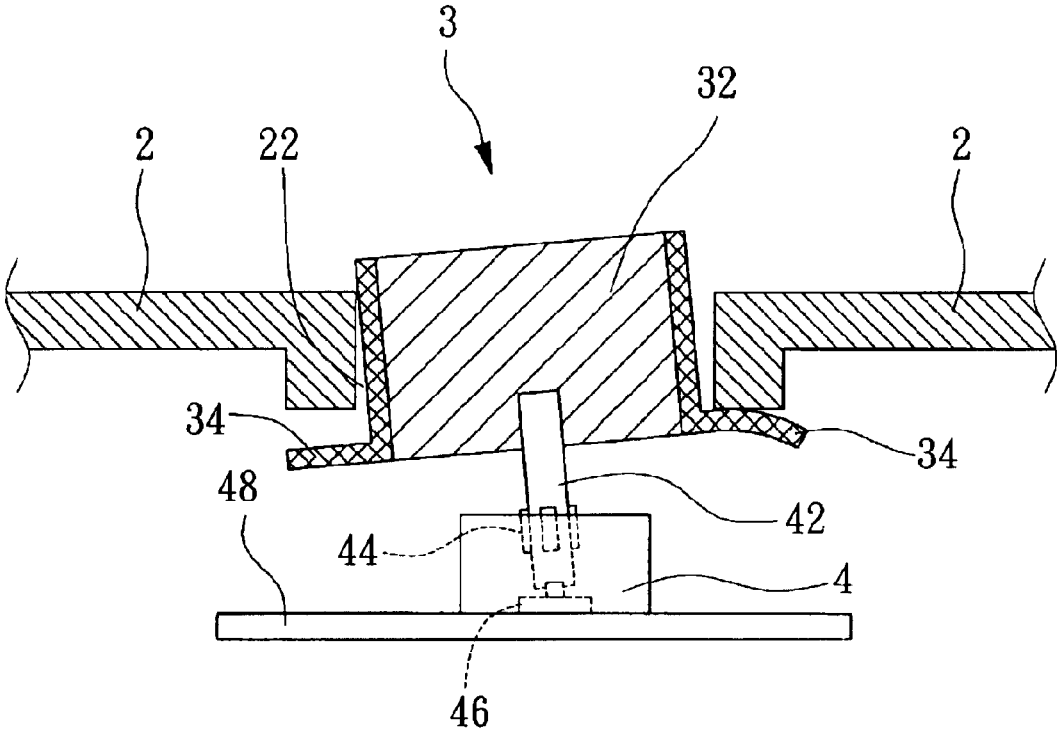
FIG. 4 is view similar to FIG. 3 showing another embodiment of the keystroke structure in accordance with the present invention.

Please refer to FIG. 4, wherein an alternative embodiment of the present invention is shown. In this embodiment, the flange 34 has an upward extending extension (not labeled) secured to and covering a whole periphery of the cap 32. In this embodiment, the bonding strength between the flange 34 and the cap 32 is enhanced to prevent a separation of the flange 34 from the cap 32 after the keystroke structure 3 is operated for a period of time. In both embodiments, the flange 34 and the cap 32 are formed by injection molding, i.e., injecting two different types of material (ABS resin and rubber) into a mold.

The description and the drawings disclosed thereinbefore are only the preferable embodiments according to the invention and are not applied to limit the practically embodying field of the invention, so any variation made according to said description and the structural characteristics and functions written in the following claims such as the change and the replacement of equivalent element is still belonged to the field of the invention; finally, please your esteemed members of reviewing committee examine this application in favorable way and grant it as a patent wishfully.

What is claimed is:

1. A keystroke structure for an electronic device, wherein the electronic device has an outer shell in which an opening is arranged, the keystroke structure comprising:

a cap arranged in the opening of the outer shell and having at least one part exposed in the opening to the outside of the outer shell;

a flange fixed to the cap and surrounding a bottom of the cap, the flange being engagable with the shell when the cap is tilted, the flange being more resilient than the cap;

a rod extending downwardly from the bottom of the cap;

a printed circuit board; and a switch assembly mounted on the printed circuit board, the switch assembly having switches for cursor direction control and a switch for "enter" control, the switches for cursor direction control being activated when the cap is tilted and the switch for "enter" control being activated when the cap is vertically depressed.

2. The keystroke structure according to claim 1, wherein the switch assembly has four switches for cursor direction control.

3. The keystroke structure according to claim 1, wherein the flange has an upward extending extension covering a whole periphery of the cap.

4. The keystroke structure according to claim 1, wherein the cap is made of hard plastics and the flange is made of resilient plastics.

5. The keystroke structure according to claim 4, wherein the cap is made of ABS resin and the flange is made of rubber.

6. An electronic device comprising:

an outer shell in which an opening is defined; a keystroke structure arranged below the opening of the outer shell, comprising:

a cap having a portion extending upward through the opening;

a flange fixed to the cap and being more elastic than the cap;

a rod extending downwardly from the cap; and a switch assembly having a first switch for a first function control and a second switch for a second function control, the first switch being activated by the rod when the cap is tilted to an extent that the flange engages with a bottom face of the shell and the second switch being activated by the rod when the cap is vertically depressed.

7. The electronic device according to claim 6, wherein the flange is arranged around a bottom of the cap.

8. The electronic device according to claim 7, wherein the flange has an upper extension covering a whole periphery of the cap.

9. The electronic device according to claim 6, wherein the electronic device is a personal digital assistant (PDA).

10. The electronic device according to claim 6, wherein the first switch is activated by a periphery of the rod and the second switch is activated by a bottom of the rod.

11. The electronic device according to claim 6, wherein the cap is made of hard plastics such as ABS resin and the flange is made of rubber.

12. A keystroke structure for a handheld electronic device in which the keystroke structure can control two different types of function of the handheld electronic device, the keystroke structure comprising:

a cap made of first material, receiving an operating force from a user of the handheld electronic device; and a flange engaging with a shell of the handheld electronic device to prevent a separation of the keystroke structure from the handheld electronic device, the flange being fixedly secured to a periphery of the cap and made of a second material more resilient than the first material for forming the cap.

13. The keystroke structure according to claim 12, wherein the keystroke structure controls a first type of function of the handheld electronic device when the cap is tilted and a second type of function of the handheld electronic device when the cap is vertically depressed.

14. The keystroke structure according to claim 13, wherein when the cap is tilted, the flange engages with the shell and is deformed.

15. The keystroke structure according to claim 14, wherein the first material is hard plastics and the second material is rubber.

16. The keystroke structure according to claim 15, wherein the hard plastics is ABS resin.

17. The keystroke structure according to claim 12, wherein the first material is hard plastics and the second material is rubber.

18. The keystroke structure according to claim 17, wherein the hard plastics is ABS resin.

* * * * *